US005133815A

United States Patent [19]

Hashimoto et al.

[11] Patent Number: 5,133,815

[45] Date of Patent: Jul. 28, 1992

[54] COLD-ROLLED STEEL SHEETS OR HOT-DIP GALVANIZED COLD-ROLLED STEEL SHEETS FOR DEEP DRAWING

[75] Inventors: Shunichi Hashimoto, Kobe; Tatsuya Asai, Nishinomiya; Mitsuru Kitamura, Kobe, all of Japan

[73] Assignee: Kabushiki Kaisha Kobe Seiko Sho, Kobe, Japan

[21] Appl. No.: 663,310

[22] Filed: Mar. 1, 1991

[30] Foreign Application Priority Data

Mar. 2, 1990 [JP] Japan ..... 2-51273
Jul. 7, 1990 [JP] Japan ..... 2-179755

[51] Int. Cl.[5] ..... C22C 38/12; C22C 38/14; C23C 8/22

[52] U.S. Cl. ..... 148/319; 420/126; 420/127

[58] Field of Search ..... 420/126, 127; 148/319; 428/610, 659

[56] References Cited

U.S. PATENT DOCUMENTS

| | | | |
|---|---|---|---|
| 3,765,874 | 10/1973 | Elias et al. | 420/126 |
| 4,473,414 | 9/1984 | Irie et al. | 420/127 |
| 4,496,400 | 1/1985 | Irie et al. | 420/127 |
| 4,750,952 | 6/1988 | Sato et al. | 420/126 |

FOREIGN PATENT DOCUMENTS

| | | | |
|---|---|---|---|
| 57-36673 | 2/1982 | Japan | 420/126 |
| 59-74259 | 4/1984 | Japan | 148/319 |
| 60-224758 | 11/1985 | Japan | 420/127 |

OTHER PUBLICATIONS

Patent Abstracts of Japan, vol. 12, No. 252, (C-512) [3099], Jul. 15, 1988 and JP-A-63 38 556.
Patent Abstracts of Japan, vol. 13, No. 313, (C-618) [3661], Jul. 17, 1989 and JP-A-1 96 330.
Patent Abstracts of Japan, vol. 9, No. 309 (C-318) [2032], Dec. 5, 1985 and JP-A-60149 729.

*Primary Examiner*—John Zimmerman
*Attorney, Agent, or Firm*—Oblon, Spivak, McClelland, Maier & Neustadt

[57] ABSTRACT

Cold-rolled steel sheets or hot-dip galvanized steel sheets for deep drawing which have excellent resistance to cold-work embrittlement, containing, all by mass, 0.01% or less C, 0.2% or less Si, 0.05–1.0% Mn, 0.10% or less P, 0.02% or less S, 0.005–0.08% sol.Al, and 0.006% or less N, containing Ti (%) and/or NB (%) solely or in combination within the range in which a relationship between the effective amount of Ti (hereinafter referred to as Ti*) defined by the following formula (1) and the amounts of Nb and C satisfies the following formula (2), and further containing 0.003% or less B when required.

$$Ti^* = \text{total } Ti - \{(48/32) \times S + (48/14) \times N\} TM \quad (1)$$

$$1 \leqq (Ti^*/48 + Nb/93)/(C/12) \leqq 4.5 \quad (2)$$

And the balance of Fe and inevitable impurities, the steel sheets have a concentration gradient as a result of carburizing.

4 Claims, 9 Drawing Sheets

| TYPE OF GAS | | CRITICAL TEMPERATURE FOR COLD-WORK EMBRITTLEMENT(°C) | AGEING INDEX AI (Kgf/mm²) |
|---|---|---|---|
| $N_2$-$H_2$ GAS | A | -70 | 0.0 |
| CARBURIZING GAS | B | -145 | 1.4 |
| CARBURIZING GAS | C | -150 | 3.3 |

| TYPE OF GAS | | CRITICAL TEMPERATURE FOR COLD-WORK EMBRITTLEMENT(°C) | AGEING INDEX AI (Kgf/mm²) |
|---|---|---|---|
| $N_2$-$H_2$ GAS | A | -65 | 0.0 |
| CARBURIZING GAS | B | -125 | 1.9 |
| CARBURIZING GAS | C | -130 | 3.2 |

| TYPE OF GAS | | AI (Kgf/mm²) | BH (Kgf/mm²) |
|---|---|---|---|
| $N_2$-$H_2$ GAS | A | 0.0 | 0.0 |
| CARBURIZING GAS | B | 1.9 | 3.0 |
| CARBURIZING GAS | C | 6.0 | 7.5 |

| TYPE OF GAS | | AI (Kgf/mm²) | BH (Kgf/mm²) |
|---|---|---|---|
| $N_2$-$H_2$ GAS | A | 0.0 | 0.0 |
| CARBURIZING GAS | B | 1.9 | 3.2 |
| CARBURIZING GAS | C | 4.0 | 5.9 |

COLD-ROLLED STEEL SHEETS OR HOT-DIP GALVANIZED COLD-ROLLED STEEL SHEETS FOR DEEP DRAWING

BACKGROUND OF THE INVENTION

1. Industrial Field of Utilization

The present invention relates to cold-rolled steel sheets or hot-dip galvanized cold-rolled steel sheets for deep drawing which have excellent resistance to cold-work embrittlement or bake hardenability and more particularly to hot-dip galvanized cold-rolled steel sheets for deep drawing which have excellent deep drawability and adhesion of galvanized coating.

2. Description of Prior Art

Cold-rolled steel sheets for use for automotive parts and outer panels of electrical equipment are required to have good press-formability and good corrosion resistance in recent years.

For manufacturing cold-rolled steel sheets which can meet the above-mentioned requirements, there has been proposed a process for the individual or compound addition of carbonitride forming elements such as Ti and Nb to ultra-low carbon steel for the purpose of stabilizing C and N in the steel, thereby developing (111) texture which is advantageous for deep drawing and for galvanizing of the steel.

However, ultra-low carbon steels in which C and N in the steels are sufficiently stabilized by the carbonitride forming elements such as Ti and Nb, have a problem that cracking due to brittle fracture occurs in cold-work after press-forming. Furthermore, P-added steels have a problem that P is segregated to the grain boundary promoting brittleness of the grain boundary. This is due to the stabilization of solid-solute C in the steel, resulting in nonsegregation of C into the ferrite grain boundary and accordingly in an embrittled grain boundary. Particularly in the case of the hot-dip galvanized steel sheet, molten zinc easily intrudes this embrittled grain boundary, thus further promoting brittleness.

This hot-dip galvanized steel sheet has the problem of powdering or flaking of the galvanized coating during press-forming, that is deteriorating adhesion of the galvanized coating.

As a means of solving the aforesaid problem of the embrittlement of grain boundary, there has been attempted to melt the steels by pre-controlling the addition of Ti and Nb so that solid-solute C and N may be left in the steels. According to this method, however, even if component steels having residual solid-solute C and N can be made, this solid-solute C and N substantially acts to deteriorate the r-value and ductility of the steels, unavoidably resulting in largely lowered press-formability. That is, the press-formability and the resistance to cold-work embrittlement cannot be compatible with each other. Besides, it is technologically impossible to leave such a slight amount of solid-solute C and N in steels at the stage of steel-making.

In connection with this respect, the following proposals have been made sofar; it is, however, difficult to obtain both excellent press-formability and excellent resistance to cold-work embrittlement.

For example for the purpose of improving the resistance to cold-work embrittlement in deep drawable steel sheets there has been proposed a method of forming a carburized layer at the surface of the steel sheets by stabilizing C in steels by adding Ti and Nb and, after cold-rolling, carburizing through open-coil annealing (laid-Open Japanese Patent Application No. Sho 63-38556). In this method, however, since carburizing is applied during a prolonged period of batch annealing, a high-concentration carburized layer is formed (an average amount of C in the carburized layer: 0.02 to 0.10%) at the surface layer of the steel, and there exists a difference in ferrite grain size between the surface layer and the central layer. Furthermore, the batch annealing process is naturally not highly productive and the mechanical properties of the steel are likely to be inhomogenous in the direction of rolling and in the direction of sheet width.

There has also been proposed a method for providing only an extremely thin surface layer with a very slight amount of solid-solute C and N for the purpose of improving phosphatability (Japanese Patent Publication No. Hei 1-4233I). According to this method, however, the resistance to cold-work embrittlement is not taken into consideration. Therefore, it is impossible to perform the carburizing step required for improving the resistance to cold-work embrittlement.

Similarly, for manufacturing steel sheets for deep drawing by addition of Ti and Nb there has also been proposed a method for further carburizing after applying recrystallization annealing after cold rolling (Laid-Open Japanese Patent Application No. Hei 1-96330). This method, however, has drawbacks in that it aims mainly at providing greater strength through the precipitation of a large amount of carbides or nitrides no consideration is taken for improvement in the resistance to cold-work embrittlement; prolonged batch carburizing and nitriding are carried out, which after annealing, causes the amount of carburizing and nitriding to become excessive and nonuniform, the producibility is low and the process is complicated.

Beside the aforementioned problem as to the improvement in the resistance to cold-work embrittlement, there is an increasing demand for the provision of properties capable of increasing yield stress of steel sheets after paint baking, that is so-called bake hardenability.

In relation to the aforementioned demand, there has been proposed a method of adding a smaller amount of Ti than atomic equivalent to C for the purpose of leaving the solid-solute C (Japanese Patent Publication No. Sho 61-2732). According to this method, however, the solid-solute C and N substantially acts to deteriorate the r-value of steel even if the component steel containing the residual solid-solute C and N can be made, with the result that the press-formability is largely lowered. That is, the press-formability and the bake hardenability are substantially incompatible with each other.

Furthermore, the aforesaid process utilizing carburizing in the annealing process (Laid-Open Japanese Patent Application No. Sho 63-38556) and the process for improving the phosphatability do not take the bake hardenability into consideration, and accordingly it is impossible to improve the bake hardenability.

Furthermore, in the case of the ultra-low carbon steels stabilizing C and N sufficiently with carbonitride forming elements such as Ti and Nb, the bake hardenability is not obtainable.

Furthermore, according to the process for containing the solid-solute C, a target value, if too high, deteriorates the ageing property, and, reversely if too low, can not obtain the bake hardenability. It is very difficult to control the optimum amount of residual solid-solute carbon in the steelmaking process.

SUMMARY OF THE INVENTION

The present invention has been accomplished in an attempt to solve the above-mentioned prior-art technological problems, and has as its object the provision of cold-rolled steel sheets or hot-dip galvanized cold-rolled steel sheets produced of ultra-low carbon steel with added Ti or Nb, which have both excellent deep drawability and excellent resistance to cold-work embrittlement or bake hardenability, and further the provision of hot-dip galvanized cold-rolled steel sheets having excellent deep drawability and excellent adhesion of galvanized coating.

In order to solve the above-mentioned problems, the inventor completed the present invention as a result of researches on chemical composition and the amount and distribution of solid-solute C contained in the steel.

The present invention discloses cold-rolled steel sheets or hot-dip galvanized cold-rolled steel sheets for deep drawing which have excellent resistance to cold-work embrittlement containing 0.01 mass % or less C, 0.2 mass % or less Si, 0.05 to 1.0 mass % Mn, 0.10 mass % or less P, 0.02 mass % or less S, 0.005 to 0.08 mass % sol.Al., and 0.006 mass or less N, further containing Ti (mass %) and/or Nb (mass %) solely or in combination within the range in which the relationship between the effective amount o Ti (hereinafter referred to as Ti*) defined by the following formula (1) and the amount of Nb with the amount of C satisfies the following formula (2), if necessary further containing 0.003 mass % or less B.

$$Ti^* = \text{total } Ti - \{(48/32) \times S + (48/14) \times N\} \quad (1)$$

$$1 \leqq (Ti^*/48 + Nb/93)/(C/12) \leqq 4.5 \quad (2)$$

and the balance of Fe and inevitable impurities, the steel sheet has such a concentration gradient that, as a result of carburizing, the amount of solid-solute C decreases as it goes through the thickness direction from the sheet surface towards the center, with the maximum value of concentration of solid-solute C in a part of a one-tenth gage ratio of the surface layer set at 15 mass ppm and with the amount of solid-solute C in the entire part of the steel sheet set at 2 to 10 mass ppm.

Another embodiment of the present invention disclose cold-rolled sheets or hot-dip galvanized steel sheets for deep drawing which have excellent bake hardenability having the same chemical composition as described above and the concentration gradient that, as a result of carburizing, the amount of solid-solute C through the thickness direction decreases as it goes from the surface towards the center of the sheet, with the maximum value of concentration of solid-solute C in a part of a one-tenth gage ratio of the surface layer set at 60 mass ppm, and with the amount of solid-solute C in the entire part of the steel sheet set at 5 to 30 mass ppm.

Furthermore, the present invention discloses hot-dip galvanized cold-rolled steel sheets which have excellent deep drawability and excellent adhesion of galvanized coating, having the same chemical composition characterized by 10 to 100 mass ppm solid-solute C present in a part 100 μm deep from the sheet surface through the thickness direction.

Hereinafter the present invention will be explained in further detail.

First, reasons for defining the chemical composition f the steels in the present invention will be explained.

C

The amount of Ti and/or Nb to be added for stabilizing C increases with an increase in carbon content, resulting in an increased amount of TiC and/or NbC precipitation and hindered grain growth and accordingly deteriorated r-value. This will increase manufacturing cost. It is, therefore, necessary to hold the carbon content below 0.01 mass % or less. The lower limit value of this carbon content at the stage of steelmaking technology, though not specially limited, should be set at 0.0003 mass % from a practical steelmaking technological point of view. It is desirable that the carbon content be set at 0.01 mass % or less, and its lower limit value at 0.0003 to 0.01 mass %.

Furthermore, as described later, in order to provide excellent resistance to cold-work embrittlement, the steel sheet is required to have the concentration gradient that the amount of solid-solute C decreases as it goes through the thickness direction from the surface towards the center, with the maximum value of concentration of solid-solute C present in a part of a one-tenth gage ratio of the surface layer set at 15 mass ppm, and with the amount of solid-solute C in the entire part of the steel sheet set at 2 to 10 mass ppm. To impart excellent bake hardenability, however, the steel should be allowed to have, in addition to the above-mentioned concentration gradient, up to 60 mass ppm of the maximum concentration of solid-solute C in the part of a one-tenth gage ratio of the surface layer, maintaining 5 to 30 mass ppm solid-solute C in the entire part of the steel sheets. Furthermore, to obtain excellent adhesion of galvanized coating, the amount of solid-solute C present in a portion 100 μm deep from the sheet surface through the thickness direction must be set at 10 to 100 mass ppm. For the purpose of presenting such a suitable condition for the existence of the solid-solute C, any means may be adopted. It is, however, desirable, from the point of view of producibility, to provide an atmosphere having a carbon potential in the annealing process before galvanizing.

Si

Si is added mainly for the purpose of deoxidizing molten steels. However, excess addition deteriorates surface property, adhesion of galvanized coating, and phosphatability or paintability. The Si content, therefore, should be held to 0.2 mass % or less.

Mn

Mn is added mainly for the prevention of hot shortness. If, however, the addition is less than 0.05 mass %, the intended effect cannot be obtained. Reversely, if the addition is too much, the ductility is deteriorated. Therefore, it is necessary to hold the content within the range of 0.05 to 1.0 mass %.

P

P is effective to increase steel strength without deteriorating the r-value. In the case of ultra-low carbon steels, P has a similar effect as carbon in connection with the galvanization reaction to improve the adhesion of galvanized coating. However, it segregates to the grain boundary, being prone to cause cold-work embrittlement. Therefore, it is necessary to control the P content to 0.10 mass % of less.

S

S combines with Ti to form TiS. With an increase in the sulfur content, an increased amount of Ti necessary for stabilizing C and N is required. Also the amount of MnS series extended inclusions increases, thus deteriorating the local ductility. Therefore it is necessary to control the content to 0.02 mass % or less.

sol.Al

Al is added for the purpose of deoxidizing molten steels. The content sol.Al, if less than 0.005 mass %, can not achieve its aim. On the other hand, if the content exceeds 0.08 mass the deoxidation effect is saturated and the amount of $Al_2O_3$ inclusion is increased to deteriorate formability. It is, therefore, necessary to hold the sol.Al content within the range of 0.005 to 0.08 mass %.

N

N combines with Ti to form TiN. Therefore, the amount of Ti required for stabilizing C increases with the increment of the N content. Besides the amount of TiN precipitation is increased to hinder the grain growth and deteriorate the r-value. Accordingly a smaller content is desirable. The N content should be controlled to 0.006% mass % or less.

Ti, Nb

These additives (mass %) are used to stabilize C and N for the purpose of increasing the r-value. To attain the aim of the present invention, therefore, it is necessary to contain them within the range that the relationship between the amount of Ti* and Nb content and the content of C satisfies the following formula (2).

$$1 \leqq (Ti^*/48 + Nb/93)/(C/12) \leqq 4.5 \quad (2)$$

Ti combines S and N as described above, forming TiS and TiN respectively; the amount of the additive to be used, therefore, is given by converting to the effective amount of Ti (amount of Ti*) according to the formula (1).

$$Ti^* = \text{total } Ti - \{(48/32) \times S + (48/14) \times N\} \quad (1)$$

When the value of the formula (2) is smaller than 1, C and N can not be sufficiently stabilized with the result that the r-value will become deteriorated. Also, the value, if exceeding 4.5, will saturate the effect which will increase the r-value, and the solid-solute Ti and/or Nb will immediately stabilize the intruded carbon during atmospheric annealing in the subsequent process. The carbon stabilization will impede C segragation to the grain boundary and the presence of solid-solute C.

B

B is an effective element to provide resistance to cold-work embrittlement and may be added when required. Also the additive may be added to improve the resistance to cold-work embrittlement in an attempt to improve the bake hardenability. If, however, the additive exceeds 0.003 mass %, its effect will be saturated, deteriorating the r-value. It is necessary, therefore, to hold the B content to 0.003 mass % or less with economical efficiency taken into consideration. With a 0.0001 mass % or less content, the aimed effect of the B added is little. It is, therefore, desirable to add the B content within the range of 0.0001 to 0.003 mass %.

Next, although the steel sheets manufacturing method in relation with the present invention is not limited in particular, but one example of the method will be explained hereinafter. Steels having the above-mentioned chemical composition are hot-rolled by customary method, that is, in austenitic region after heating up to a temperature of 1000° to 1250° C. The temperature for coiling after hot-rolling desirably is within a range from 500° C. to 800° C. for stabilizing the solid-solute C and N in the steels as carbonitrides.

In cold rolling, it is desirable to apply at a total reduction of 60 to 90% in order to develop the (111) texture advantageous for the r-value. After this cold rolling, continuous annealing is performed in a carburizing atmospheric gas within a range of over the recrystallization temperature to form the (111) texture advantageous for the r-value.

As is already known, the r-value is dependent mainly on the (111) texture of steels, which is performed by completely stabilizing the solid-solute C and N by the coiling treatment before recrystallization annealing. However, once the recrystallization is completed and the texture is formed, C and N that subsequently intrude will not give an adverse effect to the r-value. The annealing atmosphere shall be a carburizing gas with controlled carbon potential. The carbon that has intruded from the carburizing atmosphere and not stabilized as TiC and NbC segregates to the grain boundary, thereby improving the resistance to cold-work embrittlement and the adhesion of galvanized coating; and the specific amount of solid-solute C improves bake hardenability.

According to the present invention, no overageing is required, but the overageing may be performed at a temperature near a coating bath temperature. To produce galvanized cold-rolled steel sheets, the sheets are subsequently dipped into a hot zinc coating bath, and an alloying treatment may further be applied when required.

In this case, as a method for manufacturing steel sheets to be annealed, any means including hot rolling in a ferritic region, hot charge rolling, and thin slab casting and rolling may be used.

Next, a relationship between the control of the amount of solid-solute C and the resistance to cold-work embrittlement, the bake hardenability, or adhesion of galvanized coating will hereinafter be explained.

Cold-work embrittlement is prone to occur, in Ti added ultra-low carbon steels because of high purity of grain boundary and the lowered Fe-Fe bond strength in the grain boundary. Furthermore, in the hot-dip galvanizing treatment, there takes place Zn diffusion into the grain boundary, further weakening the Fe-Fe bond. Therefore, the improvement of the resistance to cold-work embrittlement can be achieved by preventing the above-mentioned two factors of lowering the Fe-Fe bond. Both the former and latter problems can be solved by segregating carbon to the grain boundary. Particularly in the case of the latter, since the depth of Zn diffusion is equal to about several grains, or about 50 μm, the above-mentioned problem can effectively be solved by concentratedly carburizing as deep as the above-mentioned through the thickness direction. An effective method of obtaining the most excellent resistance to cold-work embrittlement is to provide steel sheets having the concentration gradient that the amount of solid-solute C decreases through the thickness direction as it goes from the surface towards the center, with the maximum value of concentration of the solid-solute C in the part of a one-tenth gage ratio of the surface layer set at 15 mass ppm. Further, brittle fracture after deep drawing occurs at the surface layer, and therefore it has been confirmed that if the grain boundary strength of the surface layer has been increased by the segregation of the solid-solute C to the grain boundary, a remarkable effect is obtainable despite of little or zero grain boundary segregation of C in the centor of sheet thickness. If the amount of the solid-solute C in the surface layer exceeds 15 mass ppm, the mean amount of the solid-solute C in the entire part of the steel sheet exceeds 10 mass ppm, with the result that the effect of improvement in the resistance to cold-work embrittlement is saturated. Also, if the mean amount of the solid-solute C in the entire part of the steel sheet is less than 2 mass ppm, it is impossible to sufficiently improve the resistance to cold-work embrittlement.

In the meantime, generally in the case of the ultra-low carbon Ti-added steels, it is impossible to obtain the bake hardenability because of the absence of a residual solid-solute C. The bake hardenability, however, can be obtained while maintaining a high r-value by introducing the solid-solute C after the completion of recrystallization and then the formation of a texture. Furthermore, by providing the concentration gradient that the amount of solid-solute C decreases through the thickness direction as it goes from the sheet surface towards the center, and by setting to 60 mass ppm the maximum concentration of the solid-solute C in the part of a one-tenth gage ratio of the surface layer at which the hardening of the surface layer is most accelerated, excellent characteristics are thereby provided to automobile outer panels such as greater fatigue strength, greater resistance to panel surface damage likely to be caused by stones hitting on the surface, and greater dent resistance. The amount of the solid-solute C in the surface layer exceeding 60 mass ppm is not desirable because it becomes impossible to decrease the amount of the solid-solute C in the entire part of the sheet below 30 mass ppm and accordingly causes a problem of deterioration on mechanical properties by age. Reversely, the solid solution of C in the entire part of the sheet, if less than 5 mass ppm, is insufficient, making it impossible to obtain the bake hardenability.

The present invention is intended to improve the adhesion of galvanized coating. Its information will be described hereinafter.

For the purpose of improving the adhesion of galvanized coating, an appropriate amount of Al is usually added to the bath of molten zinc according to the type of steel. In the bath of molten zinc, Fe and Al react first as the initial reaction of the galvanizing, a Fe-Al intermetallic compound layer being formed in the interface between the molten zinc and the surface of the steel sheet. Thereafter, the galvanizing reaction including the alloying of the galvanize coating proceeds while being affected by this intermetallic compound layer. In the case of forming a uniform Fe-Al intermetallic compound layer in the interface, this compound layer is prone to work as an obstacle to mutual diffusion between the galvanized coating and the base steel sheet, and the alloying of the galvanized coating proceeds uniformly to insure good adhesion of the galvanized coating.

However, where the grain boundary of the steel sheet has been purified, Al in the bath intrudes into an activated grain boundary to lower the Al concentration in the vicinity of the grain boundary. Therefore no Al-Fe compound layer is formed in the vicinity of the grain boundary of the steel sheet, from which the galvanized coating is rapidly alloyed, forming a so-called "outburst" structure. This means that the rapid and ununiform alloying of the galvanized coating proceeds, resulting in deteriorated adhesion of the galvanized coating.

This problem can be solved to some extent by increasing the amount of Al in the zinc bath; however, increasing the amount of Al develops dross in the bath and surface defects such as craters, and lowers producibility. Thus increasing the amount of Al, therefore, can not be a fundamental solution to the problem described above.

The deteriorated adhesion of a galvanized coating on an ultra-low carbon steel sheet such as the Ti-added steel sheet is caused by the absence of segregation of carbon in ferritic grain boundaries arising from the absence of the solid-solute C in steels, and purified at grain boundaries.

In order to solve this problem, it is necessary to carburize the steels so that carbon will exist in the grain boundary in the vicinity of the sheet surface, prevent Al diffusion throughout the grain boundary in the steel sheet as the base metal, and form a uniform Fe-Al compound layer in the interface between the molten zinc and the steel sheet, preventing the occurrence of an "outburst" structure for the purpose of uniform alloying.

The present invention can be realized by improving the adhesion of galvanized coating through carburizing in the annealing process without deteriorating the formability of the steel sheets as base metal.

The steels, however, are premised to be steels of special chemical composition. In this case, however, if the amount of the solid-solute C present in a part 100 μm deep from the surface of the steel sheet through the thickness direction is under 10 mass ppm, the adhesion of galvanized coating can not be sufficiently improved. Also if the amount of the solid-solute C exceeds 100 mass ppm, there occurs deterioration of ageing property, which requires the lowering of line speed to feed a sheet in the continuous annealing process. This will result in lowered producibility. To solve this problem, it is necessary to control the amount of the solid-solute C to the range of from 10 to 100 ppm in a part 100 μm deep from the surface of the steel sheet through the thickness direction.

These and other objects of the invention will be seen by reference to the description, taken in connection with the accompanying drawings.

BRIEF DESCRIPTION OF THE DRAWINGS

FIGS. 1, 3, 5 and 7 are views each showing the distribution of solid-solute carbon through the thickness direction which is given by conversion from an internal friction value of a sample prepared by grinding in the direction of sheet thickness to the thickness of one-tenth the steel sheet of preferred embodiments 1 to 4, wherein:

FIG. 1 is a view for Steel No. 3 according to the embodiment 1;

FIG. 3 is a view for Steel No. 3 according to the embodiment 2;

FIG. 5 is a view for Steel No. 7 according to the embodiment 3;

FIG. 7 is a view for Steel No. 7 according to the embodiment 4;

DESCRIPTION OF THE PREFERRED EMBODIMENTS

Hereinafter cold-rolled steel sheets or hot-dip galvanized cold-rolled steel sheets for deep drawing according to preferred embodiments of the present invention will be described. First, the description will be made on steel sheets having excellent resistance to cold-work embrittlement and bake hardenability.

EMBODIMENT 1

The ultra-low carbon steels having the chemical composition shown in Table 1 were heated for solution treatment at 1150° C. for a period of 30 minutes and hot-rolled at a finishing temperature of 890° C. and then coiled at 670° C. After pickling, the steels were cold-rolled at a reduction of 75%. The cold-rolled steel then underwent continuous annealing in carburizing atmosphere or ($N_2$-$H_2$) gas at 780° C. for a period of 40 seconds for recrystallization annealing.

Thereafter the steels were subjected to hot-dip galvanizing at 450° C. and finally to 0.8% skin pass rolling.

The mechanical properties, amount of solid-solute C (a mean value in the direction of total sheet thickness), and critical temperature for the cold-work embrittlement of the hot-dip galvanized cold-rolled steel sheets thus obtained are shown in Table 2.

Brittleness tests were conducted to determine the critical temperature for the cold-work embrittlement of the steel sheets by trimming, to the height of 35 mm, cups prepared through cup forming at a total drawing ratio of 2.7, and then by pushing the cup placed in a refrigerant at various test temperatures, into a conical punch having an apex of 40° to measure a critical temperature at which no cracking would occur. The critical temperature thus measured is a critical temperature to be determined for embrittlement in secondary operation.

As is clear from Table 2, the steels according to the present invention have greater resistance to cold-work embrittlement than prior-art steels without contradicting requirements for the hot-dip galvanized cold-rolled steel sheets for deep drawing.

Figure 1:
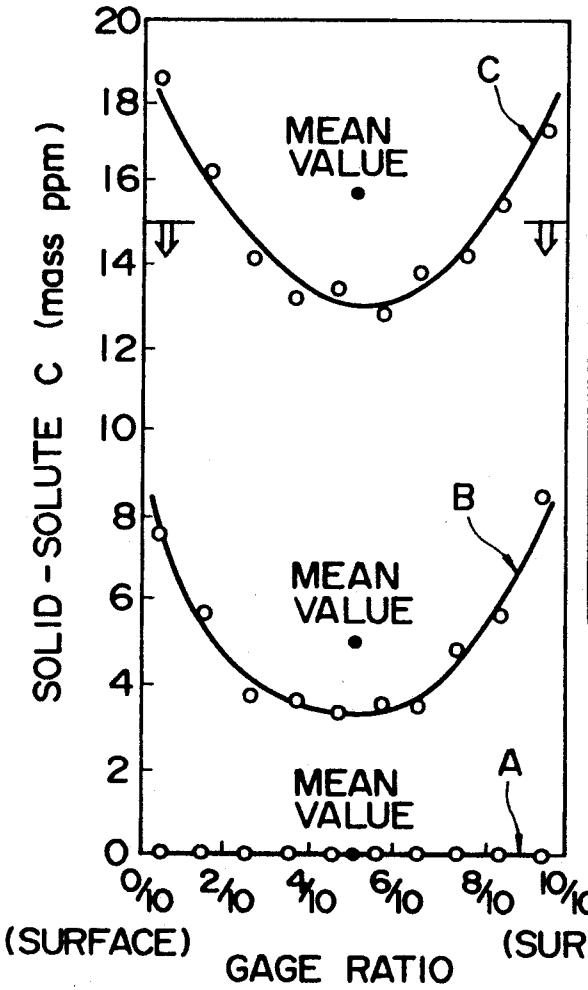
Figure 2:
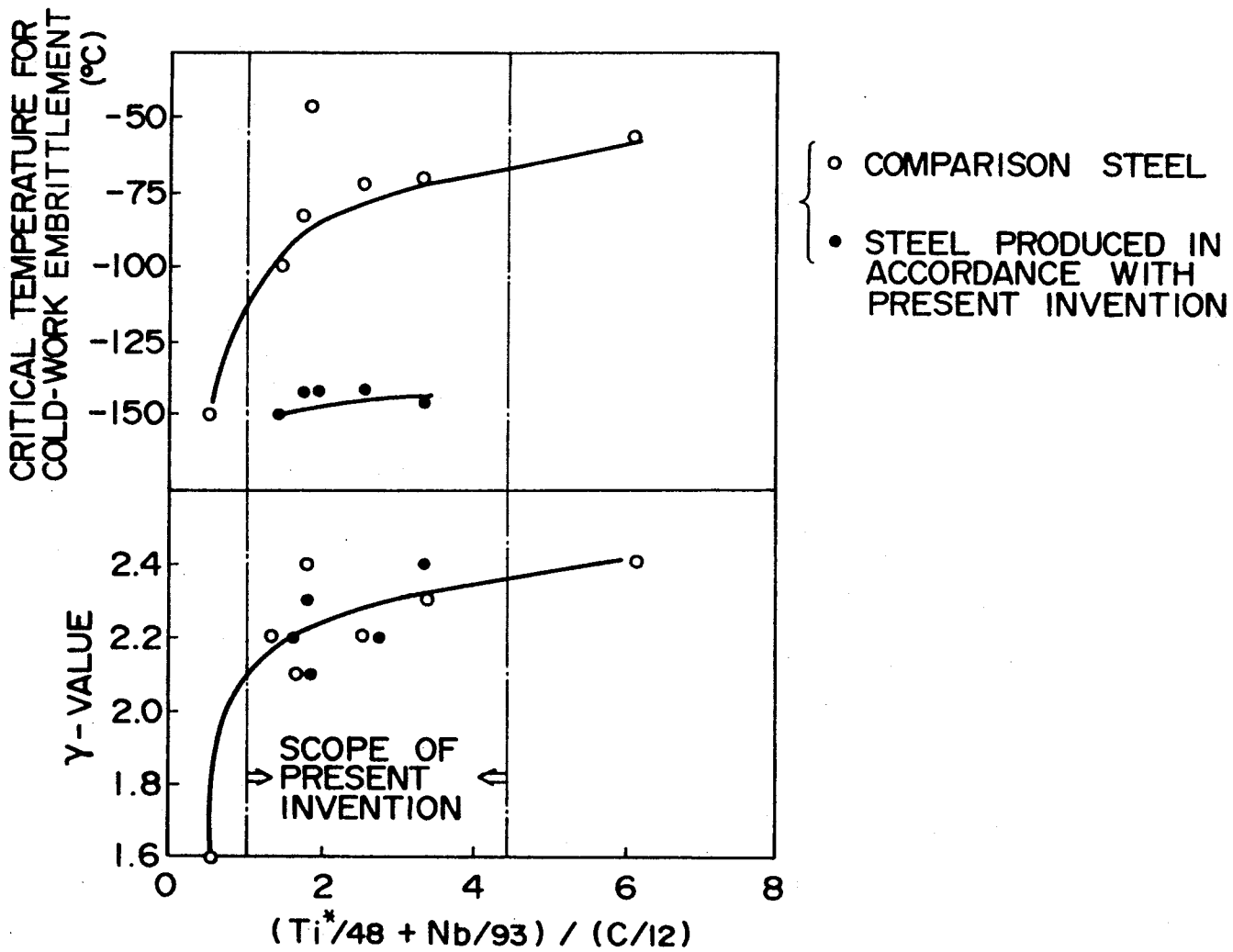
FIGS. 2, 4, 6 and 8 are views showing a relationship between (Ti*/48+Nb/93)/(C/12) and mechanical properties as regards steel sheets containing 0.02% or less P additive in the embodiments 1 to 4, for Steels No. 1, No. 2, No. 3, No. 4, No. 5, No. 7 and No. 8 according to the embodiments.

As a result of tests of the distribution of the solid-solute C through the thickness direction in Steel No. 3 of the present invention, it is seen from the concentration distribution thus tested that, in the case of a carburized steel, as shown in FIG. 1, the amount of solid-solute C decreases as it goes through the thickness direction from the surface to the center of the sheet. In addition, it has been confirmed that, in steels carburized within a gas B, the concentration of solid-solute C in the part of a one-tenth gage ratio of the surface layer is 15 mass ppm or less, and also as shown in FIG. 2, the resistance to cold-work embrittlement has been improved without deteriorating the r-value.

Meanwhile, as given in Table 2, comparison steels which do not have the chemical composition defined by the present invention and other comparison steels having the chemical composition defined by the present invention but not satisfying requirements as to the amount of solid-solute C, are both inferior either in the r-value or in the resistance to cold-work embrittlement.

TABLE 1

| | Chemical composition of Test Steels (mass %) | | | | | | | | | | |
|---|---|---|---|---|---|---|---|---|---|---|---|
| No. | C | Si | Mn | P | S | Ti | Nb | B | sol.Al | N | X |
| 1 | 0.0030 | <0.01 | 0.17 | 0.012 | 0.0081 | 0.031 | — | — | 0.028 | 0.0035 | 0.57* |
| 2 | 0.0025 | <0.01 | 0.19 | 0.008 | 0.0061 | 0.037 | — | — | 0.024 | 0.0029 | 1.79 |
| 3 | 0.0015 | <0.01 | 0.15 | 0.005 | 0.0040 | 0.042 | — | — | 0.031 | 0.0045 | 3.43 |
| 4 | 0.0042 | <0.01 | 0.31 | 0.011 | 0.010 | 0.130 | — | — | 0.029 | 0.0032 | 6.19* |
| 5 | 0.0024 | <0.01 | 0.21 | 0.009 | 0.0056 | 0.035 | — | 0.0007 | 0.027 | 0.0028 | 1.74 |
| 6 | 0.0038 | <0.01 | 0.24 | 0.044 | 0.0062 | 0.050 | 0.011 | 0.0018 | 0.037 | 0.0025 | 2.49 |
| 7 | 0.0013 | <0.01 | 0.18 | 0.018 | 0.0026 | 0.028 | — | — | 0.029 | 0.0031 | 2.59 |
| 8 | 0.0007 | <0.01 | 0.20 | 0.015 | 0.0060 | — | 0.010 | — | 0.038 | 0.0021 | 1.84 |
| 9 | 0.0015 | <0.01 | 0.22 | 0.072 | 0.0052 | — | 0.025 | — | 0.031 | 0.0025 | 2.15 |
| 10 | 0.0031 | <0.01 | 0.13 | 0.148* | 0.0049 | 0.036 | -- | 0.0022 | 0.034 | 0.0030 | 1.47 |

(Note 1) "*" These values are out of scope of the present invention.
(Note 2) X = (Ti*/48 + Nb/93)/(C/12)

TABLE 2

| | | Mechanical Properties and Critical Temperature for Cold-work Embrittlement | | | | | | |
|---|---|---|---|---|---|---|---|---|
| Steel No. | Annealing atmosphere | TS ($kgf/mm^2$) | YS ($kgf/mm^2$) | El (%) | r Value | Critical temperature for cold-work embrittlement (°C.) | amount of solid-solute C (mass ppm) | Remarks |
| 1 | ($N_2$—$H_2$) gas | 31.9 | 18.4 | 45.1 | 1.4 | −140 | 15 | Comparison steel |
| 2 | ($N_2$—$H_2$) gas | 29.7 | 14.4 | 48.6 | 1.8 | −75 | — | Comparison steel |
| | Carburizing gas | 30.2 | 15.2 | 48.9 | 1.8 | −130 | 5 | Steel produced in accordance with present invention |
| 3 | ($N_2$—$H_2$) gas | 28.2 | 16.8 | 51.0 | 2.0 | −65 | — | Comparison steel |
| | Carburizing gas | 28.8 | 15.8 | 50.6 | 2.0 | −125 | 7 | Steel produced in |

TABLE 2-continued

| Steel No. | Annealing atmosphere | TS (kgf/mm²) | YS (kgf/mm²) | El (%) | r Value | Critical temperature for cold-work embrittlement (°C.) | amount of solid-solute C (mass ppm) | Remarks |
|---|---|---|---|---|---|---|---|---|
| | | | Mechanical Properties and Critical Temperature for Cold-work Embrittlement | | | | | |
| | | | | | | | | accordance with present invention |
| 4 | Carburizing gas | 30.4 | 14.6 | 49.0 | 2.1 | −40 | 1 | Comparison steel |
| 5 | ($N_2$—$H_2$) gas | 30.5 | 14.1 | 48.7 | 1.8 | −85 | — | Comparison steel |
| | Carburizing gas | 30.3 | 15.5 | 47.6 | 1.8 | −140 | 5 | Steel produced in accordance with present invention |
| 6 | ($N_2$—$H_2$) gas | 35.2 | 17.3 | 43.8 | 1.7 | −20 | — | Comparison steel |
| | Carburizing gas | 35.4 | 19.6 | 42.5 | 1.6 | −95 | 6 | Steel produced in accordance with present invention |
| 7 | ($N_2$—$H_2$) gas | 28.3 | 12.4 | 49.3 | 1.9 | −55 | — | Comparison steel |
| | Carburizing gas | 29.5 | 12.9 | 48.1 | 1.9 | −125 | 8 | Steel produced in accordance with present invention |
| 8 | ($N_2$—$H_2$) gas | 27.1 | 11.3 | 50.5 | 1.9 | −30 | — | Comparison steel |
| | Carburizing gas | 27.9 | 12.4 | 50.1 | 2.0 | −110 | 9 | Steel produced in accordance with present invention |
| 9 | ($N_2$—$H_2$) gas | 39.5 | 21.5 | 40.7 | 1.5 | −10 | — | Comparison steel |
| | Carburizing gas | 39.8 | 22.0 | 40.5 | 1.5 | −100 | 6 | Steel produced in accordance with present invention |
| 10 | Carburizing gas | 45.2 | 24.1 | 35.4 | 1.5 | −10 | 8 | Comparison steel |

EMBODIMENT 2

The test steels having the chemical composition shown in Table 1, after recrystallization annealing in the carburizing atmosphere or in the $N_2$-$H_2$ gas through the continuous annealing process in the embodiment 1, underwent 0.8% skin pass rolling, thereby obtaining cold-rolled steel sheets. Other conditions required are the same as the embodiment 1.

The mechanical properties and amount of solid-solute C (a mean value in the direction of total sheet thickness) and critical temperature for cold-work embrittlement of the cold-rolled steel sheets thus obtained are shown in Table 3.

As is clear from Table 3, the steels according to the present invention, have greater resistance to cold-work embrittlement than prior-art steels without contradicting requirements of cold-rolled steel sheets for deep drawing.

Figure 3:
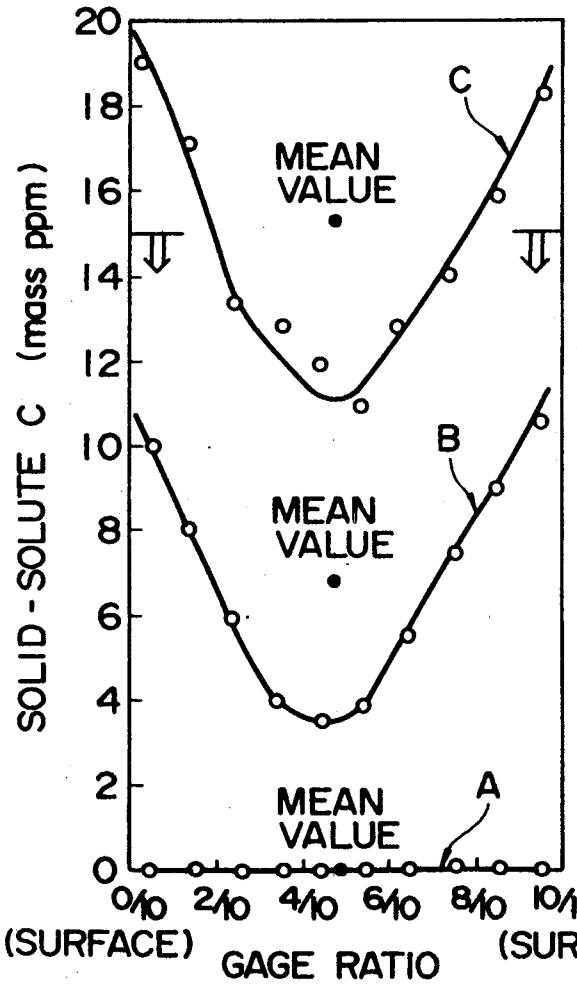
Figure 4:
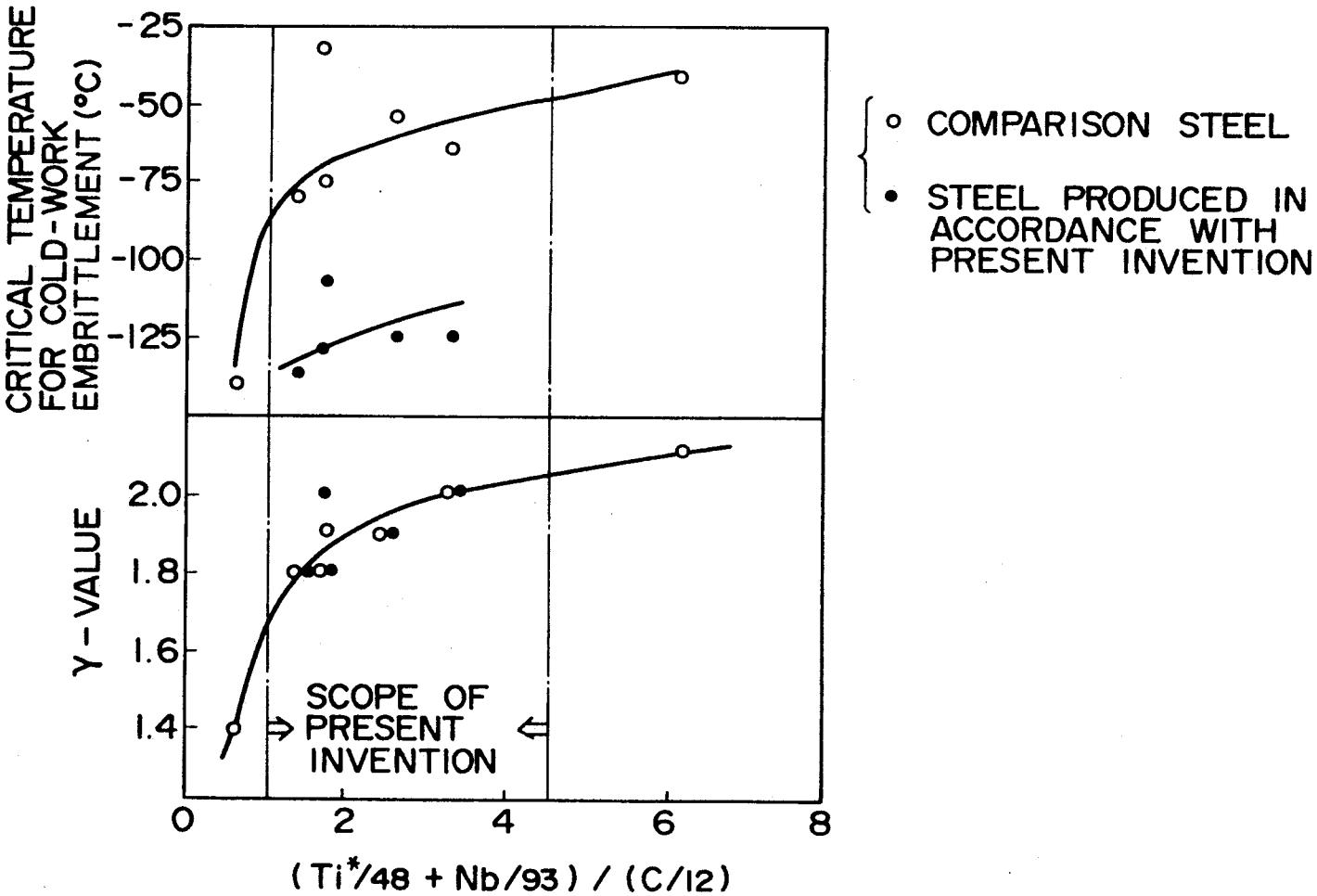

By the way, as a result of investigations of the distribution through the thickness direction of the amount of solid-solute C in Steel No. 3 according to the present invention given in Table 3, it is seen that, as shown in FIG. 3, the carburized steel indicates the distribution of concentration that the amount of solid-solute C decreases as it goes through the thickness direction from the surface towards the center. In addition, in the case of the carburizing treatment using the gas B, the amount of the solid-solute C in the part of a one-tenth gage ratio of the surface layer is 15 mass ppm or less, and it has been ascertained, as shown in FIG. 4, that the resistance to cold-work embrittlement has been improved without deteriorating the r-value.

On the other hand, as shown in Table 3, the comparison steels which do not have the chemical composition defined by the present invention and those having the same chemical composition as mentioned above but not satisfying requirements as to the amount of the solid-solute C of the present invention are inferior in either the r-value or the resistance to cold-work embrittlement.

TABLE 3

| Steel No. | Annealing atmosphere | TS (kgf/mm²) | YS (kgf/mm²) | El (%) | r Value | Critical temperature for cold-work embrittlement (°C.) | amount of solid-solute C (mass ppm) | Remarks |
|---|---|---|---|---|---|---|---|---|
| | | | Mechanical Properties and Critical Temperature for Cold-work Embrittlement | | | | | |
| 1 | ($N_2$—$H_2$) gas | 30.7 | 18.1 | 46.8 | 1.6 | −150 | 16 | Comparison steel |
| 2 | ($N_2$—$H_2$) gas | 28.7 | 13.3 | 49.6 | 2.1 | −85 | — | Comparison steel |
| | Carburizing gas | 29.4 | 14.8 | 49.5 | 2.1 | −140 | 6 | Steel produced in accordance with present invention |
| 3 | ($N_2$—$H_2$) gas | 27.9 | 15.8 | 53.3 | 2.3 | −70 | — | Comparison steel |
| | Carburizing gas | 28.2 | 15.4 | 52.6 | 2.4 | −145 | 5 | Steel produced in accordance with present invention |
| 4 | Carburizing gas | 28.4 | 14.2 | 54.2 | 2.4 | −60 | 1 | Comparison steel |
| 5 | ($N_2$—$H_2$) gas | 30.0 | 13.1 | 52.7 | 2.2 | −100 | — | Comparison steel |
| | Carburizing gas | 30.7 | 13.5 | 52.6 | 2.2 | −150 | 6 | Steel produced in accordance with present invention |
| 6 | ($N_2$—$H_2$) gas | 34.8 | 16.3 | 44.7 | 2.0 | −50 | — | Comparison steel |
| | Carburizing gas | 35.0 | 18.6 | 44.2 | 2.0 | −115 | 7 | Steel produced in accordance with |

TABLE 3-continued

| Steel No. | Annealing atmosphere | TS (kgf/mm²) | YS (kgf/mm²) | El (%) | r Value | Critical temperature for cold-work embrittlement (°C.) | amount of solid-solute C (mass ppm) | Remarks |
|---|---|---|---|---|---|---|---|---|
| | | | Mechanical Properties and Critical Temperature for Cold-work Embrittlement | | | | | |
| | | | | | | | | present invention |
| 7 | ($N_2$—$H_2$) gas | 27.8 | 12.2 | 50.6 | 2.2 | −70 | — | Comparison steel |
| | Carburizing gas | 28.2 | 12.2 | 50.1 | 2.2 | −140 | 5 | Steel produced in accordance with present invention |
| 8 | ($N_2$—$H_2$) gas | 27.3 | 11.2 | 54.4 | 2.4 | −45 | — | Comparison steel |
| | Carburizing gas | 27.9 | 11.5 | 53.6 | 2.3 | −140 | 4 | Steel produced in accordance with present invention |
| 9 | ($N_2$—$H_2$) gas | 38.3 | 21.9 | 42.0 | 1.8 | −30 | — | Comparison steel |
| | Carburizing gas | 39.0 | 22.4 | 41.8 | 1.8 | −120 | 4 | Steel produced in accordance with present invention |
| 10 | Carburizing gas | 44.6 | 23.7 | 35.9 | 1.9 | −40 | 6 | Comparison steel |

EMBODIMENT 3

The test steel having the chemical composition shown in Table 1 are subjected, after cold-rolling, to one-minute recrystallization annealing at 800° C. within the carburizing atmosphere or a ($N_2$-$H_2$) gas in the annealing process prior to galvanizing, then to hot-dip galvanizing at 450° C., and finally to 0.8% skin pass rolling.

Mechanical properties, amount of solid-solute C (a mean value in the direction of total sheet thickness), ageing index (AI), and bake hardenability (BH) of hot-dip galvanized steel sheets are given in Table 4.

The aging property was evaluated at AI. AI was given, using $AI=\sigma_2-\sigma_1$, from a stress ($\sigma_1$) at the time of 10% stretching and a lower yield stress ($\sigma_2$) at the time of re-stretching after one hour aging at 100° C.

The bake hardenability was evaluated at BH. BH was obtained, using $BH=\sigma_4-\sigma_3$, from a stress ($\sigma_3$) at the time of 2% stretching and a lower yield stress ($\sigma_4$) at the time of re-stretching after 20 min. ageing at 170° C.

As is clear from Table 4, the steels produced in accordance with the present invention have excellent bake hardenability, as compared with prior-art steels, without contradicting requirements for hot-dip galvanized cold-rolled steel sheets for deep drawing. Also, these steels have good ageing property.

Figure 5:
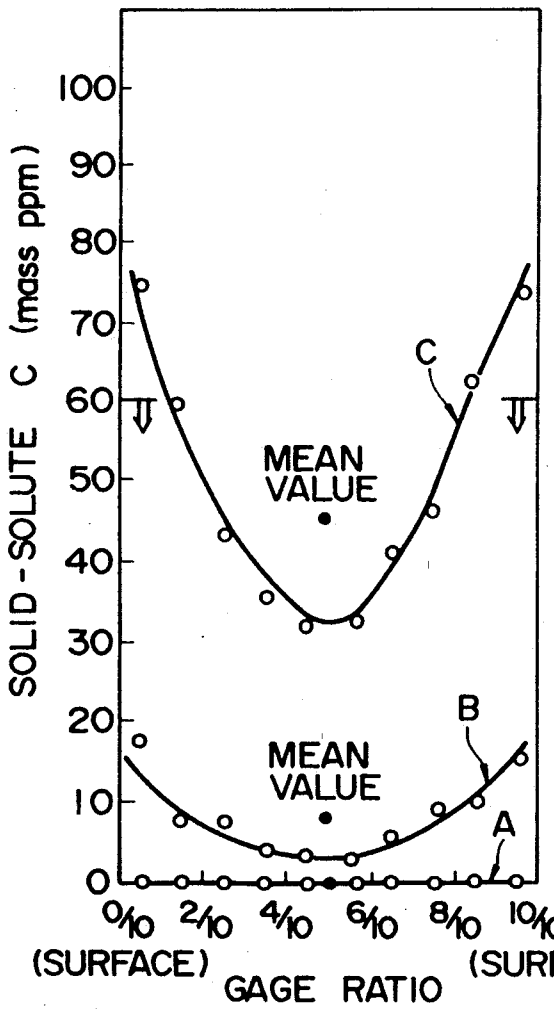
Figure 6:
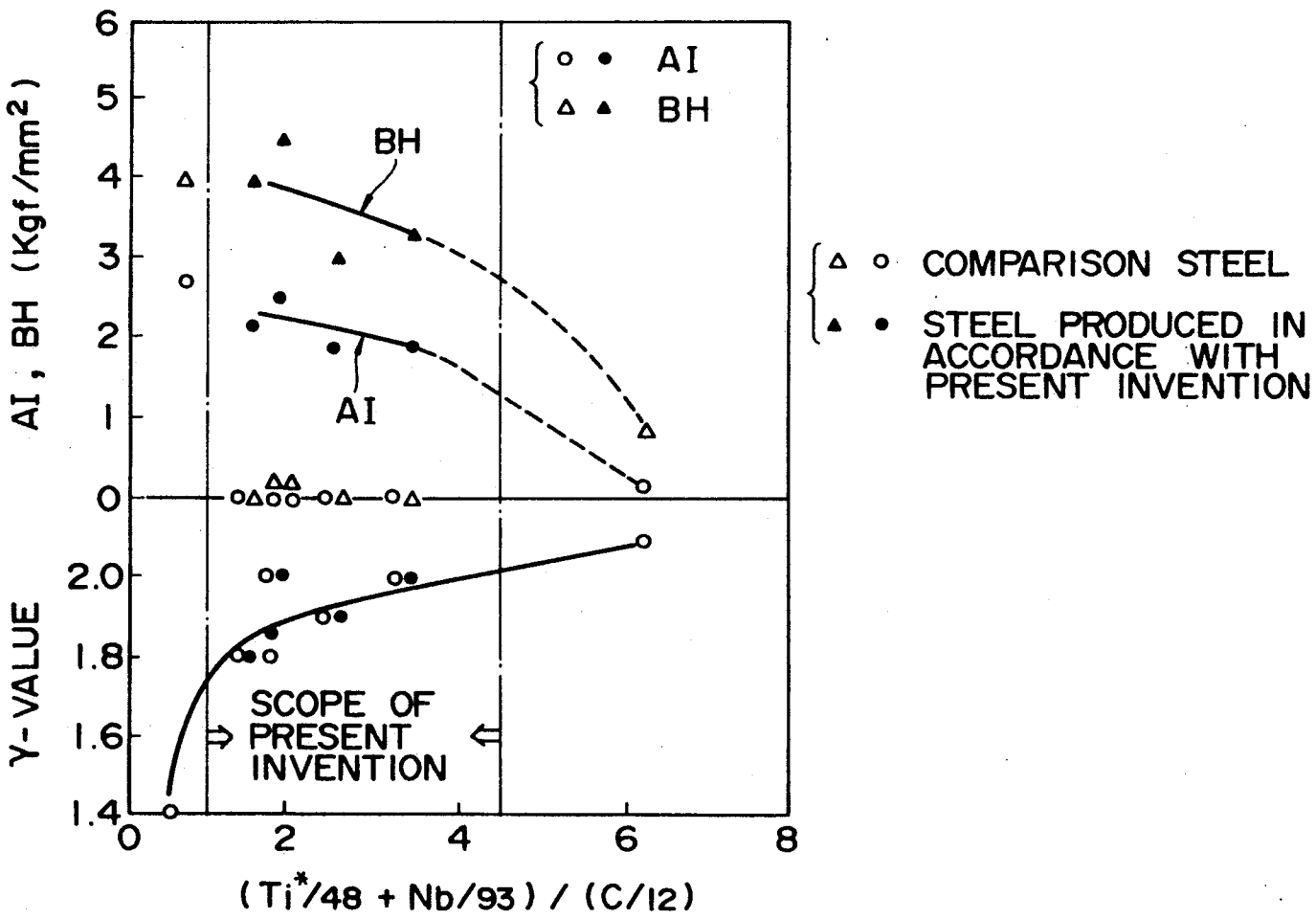

As a result of tests conducted on the distribution of the amount of solid-solute C through the thickness direction of sheets produced of Steel 7 of the present invention given in Table 4, the carburized steel shows the concentration distribution that the amount of solid-solute C decreases as it goes from the surface towards the center through the thickness direction as shown in FIG. 5. Moreover, in the case of steel carburized within the gas B, it has been ascertained that the concentration of the solid-solute C in the part of a one-tenth gage ratio of the surface layer is 60 mass ppm or less and that the bake hardenability has been improved without deteriorating the r-value.

In the meantime, as shown in Table 4, the comparison steels which do not have the chemical composition defined by the present invention, and the comparison steels having the chemical composition defined by the present invention but not satisfying requirements as to the amount of solid-solute C of the present invention are both inferior in either the r-value or the bake hardenability.

TABLE 4

| Steel No. | Annealing atmosphere | TS (kgf/mm²) | YS (kgf/mm²) | El (%) | r Value | AI (Kgf/mm²) | BH (kgf/mm²) | amount of solid-solute C (mass ppm) | Remarks |
|---|---|---|---|---|---|---|---|---|---|
| | | | Mechanical Properties, Ageing Index (AI), and Bake Hardenability (BH) | | | | | | |
| 1 | ($N_2$—$H_2$) gas | 31.6 | 18.8 | 46.1 | 1.4 | 2.8 | 4.0 | 16 | Comparison steel |
| 2 | ($N_2$—$H_2$) gas | 29.7 | 14.3 | 49.0 | 1.8 | 0.0 | 0.2 | — | Comparison steel |
| | Carburizing gas | 30.5 | 15.0 | 48.2 | 1.9 | 2.0 | 3.7 | 13 | Steel produced in accordance with present invention |
| 3 | ($N_2$—$H_2$) gas | 28.5 | 15.8 | 50.0 | 2.0 | 0.0 | 0.0 | — | Comparison steel |
| | Carburizing gas | 29.8 | 16.2 | 49.6 | 2.0 | 1.9 | 3.3 | 10 | Steel produced in accordance with present invention |
| 4 | Carburizing gas | 29.8 | 16.6 | 51.0 | 2.1 | 0.2 | 0.9 | 3 | Comparison steel |
| 5 | ($N_2$—$H_2$) gas | 31.1 | 14.9 | 47.7 | 1.8 | 0.0 | 0.0 | — | Comparison steel |
| | Carburizing gas | 31.9 | 16.0 | 47.1 | 1.8 | 2.1 | 4.0 | 15 | Steel produced in accordance with present invention |
| 6 | ($N_2$—$H_2$) gas | 35.2 | 17.7 | 43.5 | 1.7 | 0.0 | 0.0 | — | Comparison steel |
| | Carburizing gas | 35.9 | 19.0 | 42.5 | 1.7 | 2.0 | 3.7 | 12 | Steel produced in accordance with present invention |
| 7 | ($N_2$—$H_2$) gas | 29.3 | 13.4 | 47.3 | 1.9 | 0.0 | 0.0 | — | Comparison steel |
| | Carburizing gas | 30.5 | 14.0 | 47.1 | 1.9 | 1.9 | 3.0 | 8 | Steel produced in accordance with present invention |
| 8 | ($N_2$—$H_2$) gas | 29.1 | 14.3 | 50.1 | 2.0 | 0.0 | 0.1 | — | Comparison steel |

TABLE 4-continued

| Steel No. | Annealing atmosphere | TS (kgf/mm²) | YS (kgf/mm²) | El (%) | r Value | AI (Kgf/mm²) | BH (kgf/mm²) | amount of solid-solute C (mass ppm) | Remarks |
|---|---|---|---|---|---|---|---|---|---|
| | | Mechanical Properties, Ageing Index (AI), and Bake Hardenability (BH) | | | | | | | |
| | Carburizing gas | 29.6 | 15.0 | 50.0 | 2.0 | 2.5 | 4.5 | 18 | Steel produced in accordance with present invention |
| 9 | ($N_2$—$H_2$) gas | 38.9 | 23.3 | 40.6 | 1.5 | 0.0 | 0.0 | — | Comparison steel |
| | Carburizing gas | 40.0 | 24.7 | 40.0 | 1.5 | 1.7 | 3.1 | 7 | Steel produced in accordance with present invention |
| 10 | Carburizing gas | 45.8 | 27.9 | 35.0 | 1.5 | 5.3 | 6.5 | 33 | Comparison steel |

EMBODIMENT 4

The test steels having the chemical composition in Table 1, in the embodiment 3, were continuously annealed for recrystallization annealing within a carburizing atmosphere or an ($N_2$-$H_2$) gas, cooled down to 400° C. at a cooling rate of about 80° C./s, then overaged for 3 min. at 400° C., and finally subjected to 1% skin pass rolling, thereby obtaining cold-rolled steel sheets. Other conditions are the same as those of the embodiment 3.

Mechanical properties, amount of solid-solute C (a mean value in the direction of total sheet thickness), ageing index (AI), and bake hardenability (BH) of the cold-rolled steel sheets thus prepared are shown in Table 5.

As is clear from Table 5, the steels produced in accordance with the present invention are provided with excellent bake hardenability, as compared with prior-art steels, without contradicting requirements for the cold-rolled steel sheets for deep drawing, and also with good ageing property.

Figure 7:
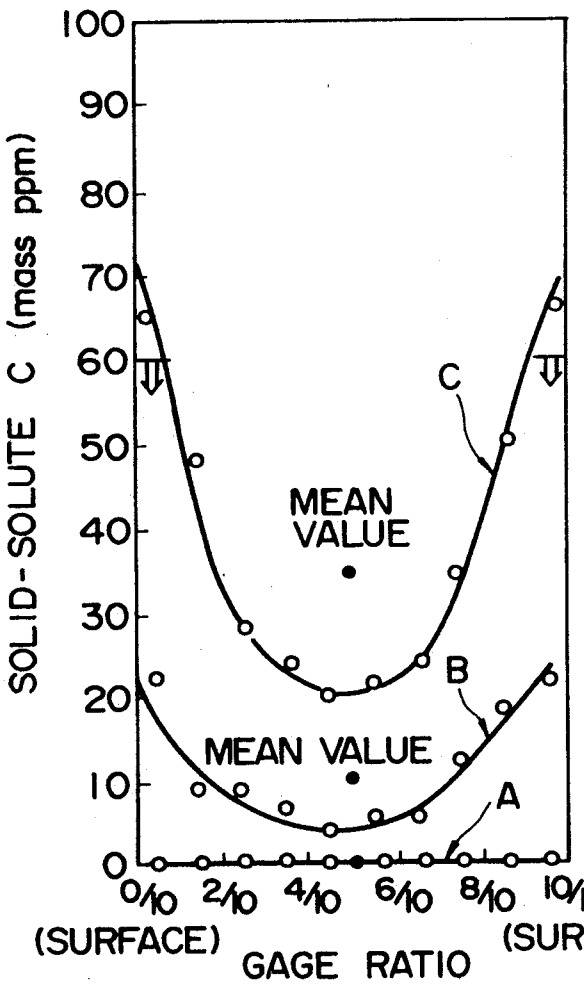
Figure 8:
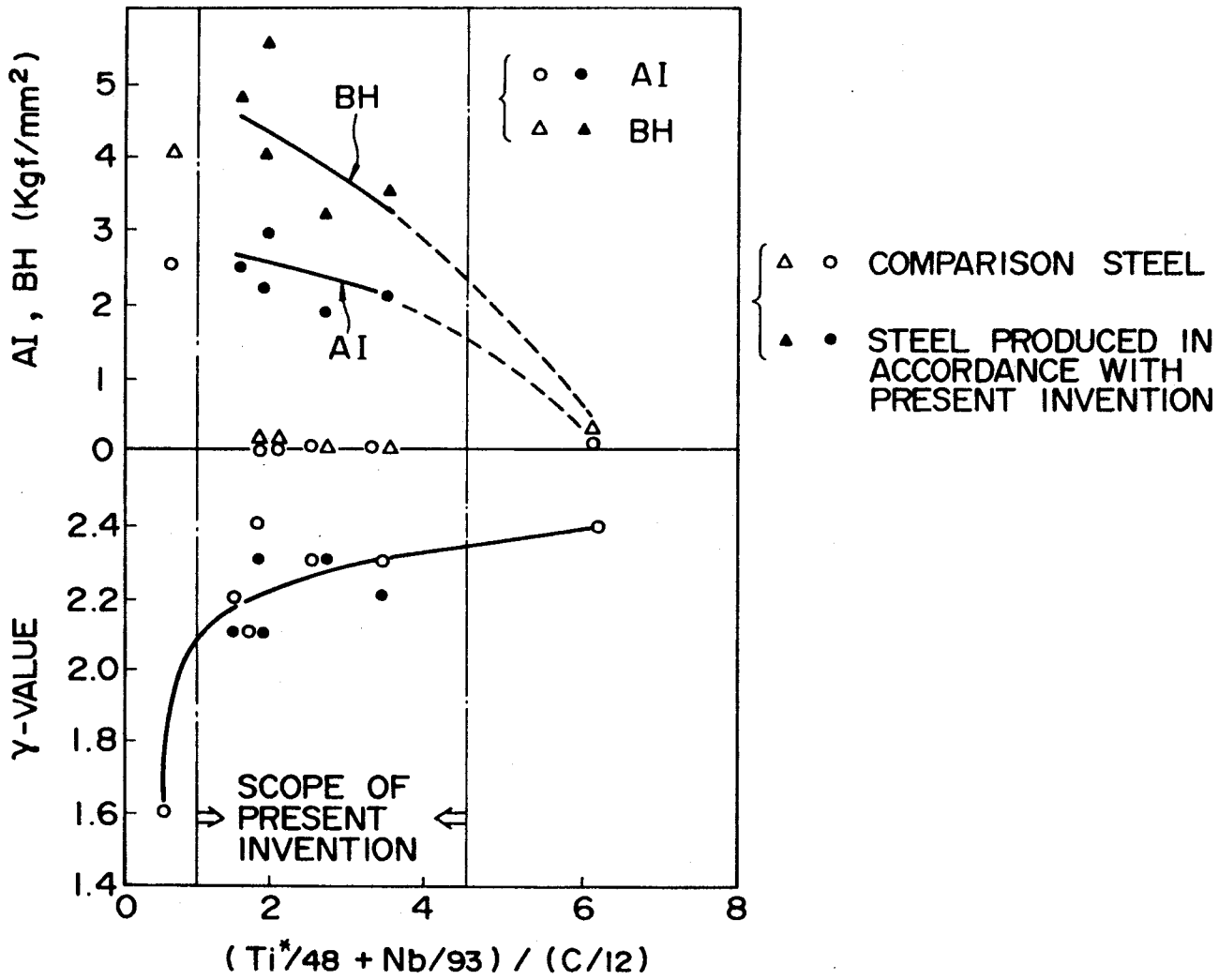

By the way, as a result of tests of the distribution of the amount of solid-solute C through the thickness direction of Steel No. 7 of the present invention given in Table 5, the steel carburized, as shown in FIG. 7, has the concentration distribution that the amount of solid-solute C decreases through the thickness direction from the surface towards the center. Furthermore, it has been ascertained that, in steels carburized in the gas B, the concentration of solid-solute C in the part of a one-tenth gage ratio of the surface layer is 60 mass ppm or less, and that the steels are provided with improved bake hardenability without deteriorating the r-value.

Meanwhile, as shown in Table 5, comparison steels not having the chemical composition defined by the present invention, and comparison steels having the chemical composition but not satisfying requirements as to the amount of solid-solute of the present invention are inferior in either the r-value or the bake hardenability.

TABLE 5

| Steel No. | Annealing atmosphere | TS (kgf/mm²) | YS (kgf/mm²) | El (%) | r Value | AI (Kgf/mm²) | BH (kgf/mm²) | amount of solid-solute C (mass ppm) | Remarks |
|---|---|---|---|---|---|---|---|---|---|
| | | Mechanical Properties, Ageing Index (AI) Proparty, and Bake Hardenability (BH) | | | | | | | |
| 1 | ($N_2$—$H_2$) gas | 30.6 | 17.8 | 47.1 | 1.6 | 2.5 | 4.0 | 15 | Comparison steel |
| 2 | ($N_2$—$H_2$) gas | 28.7 | 13.3 | 49.6 | 2.1 | 0.0 | 0.1 | — | Comparison steel |
| | Carburizing gas | 30.2 | 15.2 | 48.2 | 2.1 | 2.2 | 4.0 | 15 | Steel produced in accordance with present invention |
| 3 | ($N_2$—$H_2$) gas | 28.2 | 14.8 | 53.0 | 2.3 | 0.0 | 0.0 | — | Comparison steel |
| | Carburizing gas | 28.8 | 15.2 | 52.6 | 2.2 | 2.1 | 3.5 | 12 | Steel produced in accordance with present invention |
| 4 | Carburizing gas | 28.4 | 14.6 | 53.0 | 2.4 | 0.1 | 0.2 | 2 | Comparison steel |
| 5 | ($N_2$—$H_2$) gas | 30.1 | 14.4 | 51.7 | 2.2 | 0.0 | 0.0 | — | Comparison steel |
| | Carburizing gas | 30.9 | 16.5 | 49.6 | 2.1 | 2.5 | 4.8 | 18 | Steel produced in accordance with present invention |
| 6 | ($N_2$—$H_2$) gas | 34.2 | 17.3 | 44.8 | 1.9 | 0.0 | 0.1 | — | Comparison steel |
| | Carburizing gas | 34.9 | 19.6 | 44.5 | 1.9 | 2.4 | 3.8 | 16 | Steel produced in accordance with present invention |
| 7 | ($N_2$—$H_2$) gas | 28.3 | 13.4 | 52.3 | 2.3 | 0.0 | 0.0 | — | Comparison steel |
| | Carburizing gas | 28.5 | 14.3 | 51.1 | 2.3 | 1.9 | 3.2 | 10 | Steel produced in accordance with present invention |
| 8 | ($N_2$—$H_2$) gas | 28.1 | 14.3 | 53.5 | 2.4 | 0.0 | 0.1 | — | Comparison steel |
| | Carburizing gas | 28.6 | 15.7 | 52.8 | 2.3 | 2.9 | 5.5 | 25 | Steel produced in accordance with present invention |
| 9 | ($N_2$—$H_2$) gas | 38.6 | 22.3 | 42.6 | 1.8 | 0.0 | 0.0 | — | Comparison steel |
| | Carburizing gas | 40.3 | 24.5 | 41.8 | 1.8 | 1.4 | 3.0 | 7 | Steel produced in accordance with present invention |
| 10 | Carburizing gas | 45.3 | 26.9 | 35.7 | 1.7 | 5.5 | 6.8 | 36 | Comparison steel |

Next, the hot-dip galvanized cold-rolled steel sheets having excellent adhesion of galvanized coating according to another embodiment of the present invention will hereinafter be described.

EMBODIMENT 5

Ultra-low carbon steel sheets having the chemical composition shown in Table 6 were heated at 1150° C. for a period of 30 minutes for solution treatment, hot-rolled at a finishing temperature of 890° C., coiled at 720° C., and then, after pickling, cold-rolled at a reduction of 75%, to the sheet thickness of 0.8 mm.

Subsequently, in a hot-dip galvanizing line, the steel sheets were continuously annealed at 780° C. for 40 sec for recrystallization annealing within a carburizing atmosphere or a $N_2$-$H_2$ atmosphere, cooled down to 500° C., then hot-dipped for galvanizing, and finally processed at 600° C. for 40 sec for alloying treatment.

Table 7 shows the mechanical properties and ageing property, adhesion of coating and the amount of solid-solute C, of hot-dip galvanized cold-rolled steel sheets thus obtained.

To evaluate the adhesion of galvanized coating, the sheet was formed to a height of 60 mm with a 5 mm high bead, using a 50 mm wide punch and a 52 mm wide die, and the adhesion was evaluated by classifying the state of peeled off tape into three stages: Good (o), slightly poor (Δ) and poor (x) from the amount of coating peeled off by tape.

To measure the amount of solid-solute C, the amount of carbide and the amount of free carbon in the steel were separated. That is, the amount of free carbon was found of a sample where both faces were ground for the thickness of 100 μm from the surface and a sample not ground, and a half of a difference between the two samples was determined as the amount of solid-solute C included in the depth of 100 μm measured in the direction of sheet thickness from the surface.

The ageing property was evaluated at AI. AI was found, using the equation $AI=\sigma_2-\sigma_1$, from the stress ($\sigma_1$) at the time of 10% stretching and the lower yield stress ($\sigma_2$) at the time of re-stretching after 1 hr ageing at 100° C.

As is clear from Table 7, all examples of the present invention, as compared with prior-art steels, have provided excellent adhesion of galvanized coating without contradicting requirements for hot-dip galvanized cold-rolled steel sheets for deep drawing.

Figure 9:
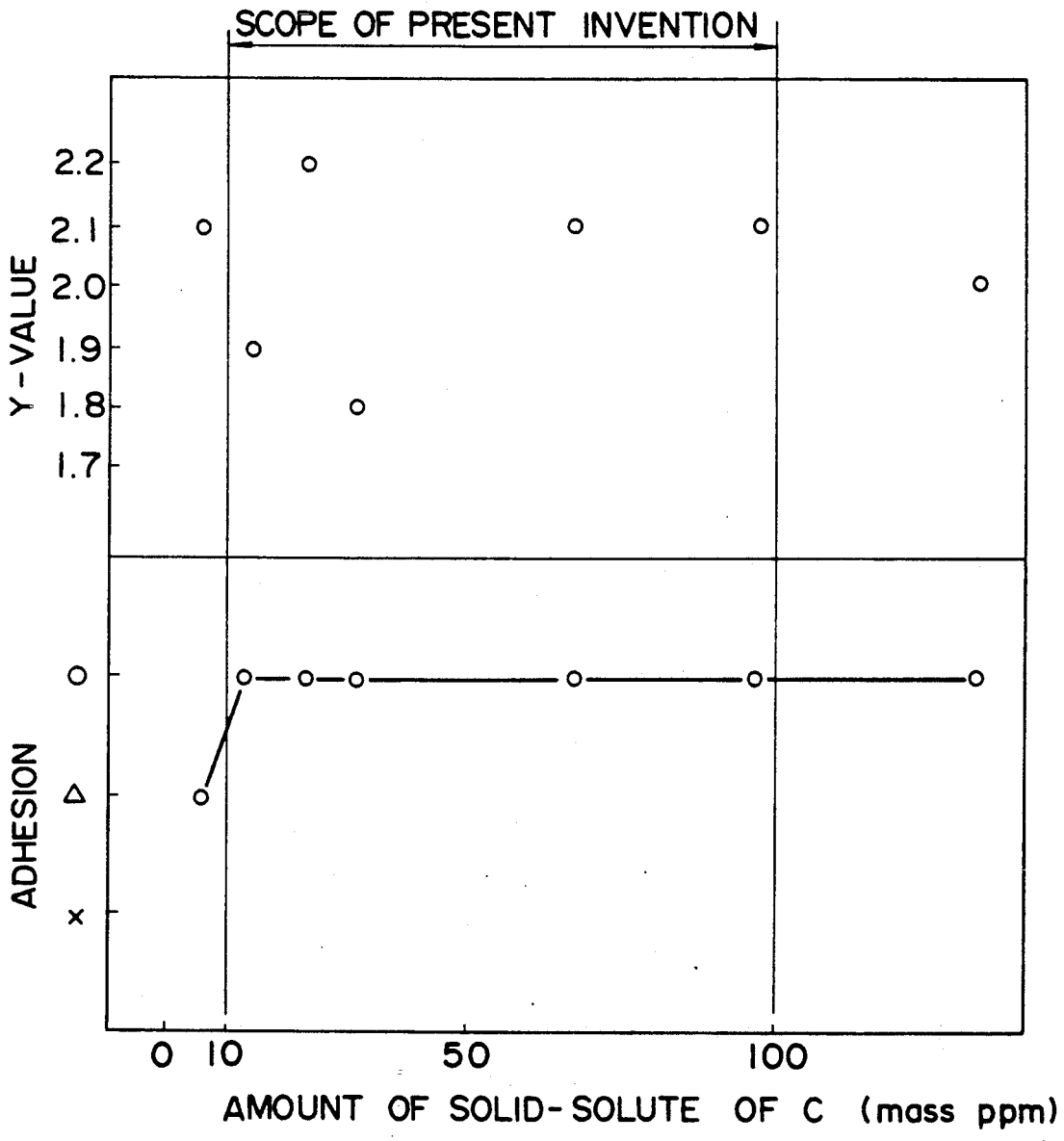
FIG. 9 is a view showing a relationship between the amount of solid-solute carbon up to 100 μm thick from the surface of steel through the thickness direction and the r-value and the adhesion of galvanized coating in the embodiment 5.

FIG. 9 shows a relationship between the amount of solid-solute C present in the steels in Table 7 up to the depth of 100 μm from the surface of the steel sheet through the thickness direction and the r-value, and the adhesion of the galvanized coating.

From Table 7 and FIG. 9, it is understood that the steels defined by the present invention have improved the adhesion of galvanized coating without deteriorating the r-value by the carburizing treatment.

TABLE 6

| | Chemical Composition of Test Steels (mass %) | | | | | | | | | | |
|---|---|---|---|---|---|---|---|---|---|---|---|
| No. | C | Si | Mn | P | S | Ti | Nb | B | sol.Al | N | X |
| 1 | 0.0016 | | 0.18 | 0.012 | 0.0048 | 0.027 | — | — | 0.025 | 0.0024 | 1.81 |
| 2 | 0.0029 | | 0.21 | 0.009 | 0.0038 | 0.050 | — | — | 0.030 | 0.0040 | 2.64 |
| 3 | 0.0025 | | 0.14 | 0.012 | 0.0032 | 0.038 | 0.024 | 0.0024 | 0.034 | 0.0028 | 3.60 |
| 4 | 0.0044 | | 0.19 | 0.046 | 0.0061 | 0.052 | — | — | 0.036 | 0.0028 | 1.89 |
| 5 | 0.0021 | <0.2 | 0.26 | 0.011 | 0.0038 | 0.065 | — | — | 0.027 | 0.0030 | 2.11 |
| 6 | 0.0026 | | 0.17 | 0.012 | 0.0056 | 0.038 | — | — | 0.025 | 0.0030 | 1.86 |
| 7 | 0.0027 | | 0.22 | 0.081 | 0.0053 | — | 0.036 | — | 0.029 | 0.0032 | 1.72 |
| 8 | 0.0042 | | 0.20 | 0.016 | 0.0058 | — | 0.020 | — | 0.030 | 0.0036 | 0.61 |
| 9 | 0.0021 | | 0.26 | 0.011 | 0.0068 | 0.080 | — | — | 0.027 | 0.0030 | 7.09 |

(Note) X = (Ti*/48 + Nb/93)/(C/12) where Ti* = total Ti-((48/32) × S + (48/14) × N)

TABLE 7

| Steel No. | Annealing atmosphere | TS (kgf/mm²) | YS (kgf/mm²) | El (%) | r Value | AI (Kgf/mm²) | Adhesion of coating | amount of solid-solute C (mass ppm) | Remarks |
|---|---|---|---|---|---|---|---|---|---|
| 1 | ($N_2$—$H_2$) gas | 28.3 | 13.1 | 52.3 | 2.2 | 0.0 | Δ | — | Example of comparison steel |
| | Carburizing gas | 28.9 | 16.6 | 50.9 | 2.1 | 3.9 | O | 97 | Example of steel according to present invention |
| 2 | ($N_2$—$H_2$) gas | 29.8 | 12.9 | 53.2 | 2.3 | 0.0 | X | — | Example of comparison steel |
| | Carburizing gas | 29.7 | 15.8 | 51.4 | 2.2 | 1.8 | O | 23 | Example of according to present invention |
| 3 | ($N_2$—$H_2$) gas | 31.5 | 15.2 | 48.4 | 2.0 | 0.0 | X | — | Example of comparison steel |
| | Carburizing gas | 31.7 | 15.9 | 47.7 | 1.9 | 1.1 | O | 13 | Example of according to present invention |
| 4 | ($N_2$—$H_2$) gas | 34.6 | 17.1 | 44.6 | 1.9 | 0.0 | X | — | Example of comparison steel |
| | Carburizing gas | 35.4 | 18.3 | 43.8 | 1.8 | 1.9 | O | 31 | Example of according to present invention |
| 5 | ($N_2$—$H_2$) gas | 30.8 | 13.9 | 49.3 | 2.2 | 0.0 | X | — | Example of comparison steel |
| | Carburizing gas | 30.5 | 14.1 | 48.9 | 2.1 | 2.4 | O | 67 | Example of according to present invention |
| 6 | ($N_2$—$H_2$) gas | 29.3 | 14.5 | 51.3 | 2.1 | 0.0 | Δ | — | Example of comparison steel |
| | Carburizing gas | 28.8 | 16.6 | 50.7 | 2.1 | 0.7 | Δ | 6 | Example of comparison steel |
| 7 | ($N_2$—$H_2$) gas | 38.8 | 21.0 | 42.1 | 1.8 | 0.0 | Δ | — | Example of comparison steel |
| | Carburizing gas | 39.2 | 21.5 | 42.0 | 1.7 | 5.1 | O | 133 | Example of comparison steel |
| 8 | ($N_2$—$H_2$) gas | 29.4 | 17.6 | 47.2 | 1.5 | 4.8 | O | 114 | Example of comparison steel |
| 9 | Carburizing gas | 30.8 | 13.9 | 48.3 | 2.2 | 0.3 | Δ | 3 | Example of comparison steel |

According to the present invention, as described in detail, the chemical composition of the ultra-low carbon steel was adjusted and the amount of solid-solute C and its distribution through the thickness direction were regulated, thereby enabling improved production and provision of steel sheets having excellent resistance to cold-work embrittlement and/or bake hardenability without contradicting requirements for the cold-rolled steel sheets or hot-dip galvanized cold-rolled steel sheets for deep drawing. Furthermore, according to the present invention, it is possible to obtain hot-dip galvanized cold-rolled steel sheets for deep drawing having excellent deep drawability and excellent adhesion of galvanized coating.

It is to be understood that the above description of the present invention is susceptible to various modifications, changes and adaptations and the same are intended to be comprehended within the meaning and range of equivalents of the appended claims.

What is claimed is:

1. Cold-rolled steel sheets or hot-dip galvanized steel sheets for deep drawing which have excellent resistance to cold-work embrittlement, having a chemical composition containing, all by mass, 0.01% or less C, 0.2% or less Si, 0.05–1.0% Mn, 0.10% or less P, 0.02% or less S, 0.005–0.08% sol.Al, and 0.006% or less N, and further containing Ti(mass %) and/or Nb(mass %) solely or in combination within a range in which a relationship between the effective amount of Ti (hereinafter referred to as Ti*) defined by the following formula (1) and the amounts of Nb and C satisfies the following formula (2), $$Ti^* = \text{total Ti} - \{(48/32) \times S + (48/14) \times N\} \quad (1)$$

$$1 \leqq (Ti^*/48 + Nb/93)/(C/12) \leqq 4.5 \quad (2)$$

and the balance of Fe and inevitable impurities, characterized in that said steel sheets have a concentration gradient that, as a result of carburizing, the amount of solid-solute carbon decreases, as it goes through the thickness direction from the surface towards the center of said steel sheets, and that a maximum value of concentration of solid-solute carbon present in a part of a one-tenth gage ratio of a surface layer is set at 15 mass ppm, and the amount of solid-solute carbon contained in the entire part of said steel sheets is set at 2 to 10 mass ppm.

2. Cold-rolled steel sheets or hot-dip galvanized steel sheets for deep drawing which have excellent bake hardenability, having a chemical composition containing, all by mass, 0.01% or less C, 0.2% or less Si, 0.05–1.0% Mn, 0.10% or less P, 0.02% or less S, 0.005–0.08% sol.Al, and 0.006% or less N, and further containing Ti (mass %) and/or Nb (mass %) solely or in combination within a range in which a relationship between the effective amount of Ti (hereinafter referred to as Ti*) defined by the following formula (1) and the amount of Nb and C satisfies the following formula (2), $$Ti^* = \text{total } Ti = \{(48/32) \times S + (48/14) \times N\} \quad (1)$$

$$1 \leqq (Ti^*/48 + Nb/93)/(C12) \leqq 4.5 \quad (2)$$

and the balance of Fe and inevitable impurities, wherein said steel sheets have a concentration gradient that the amount of solid-solute carbon decreases, as a result of carburizing, as it goes through the thickness direction from the surface towards the center of said steel sheets, and that a maximum value of concentration of solid-solute carbon in a part of a one-tenth gage ratio of the surface layer is set at 60 mass ppm and the amount of solid solute carbon in the entire part of said steel sheets is set at 5 to 30 mass ppm.

3. Hot-dip galvanized cold-rolled steel sheets for deep drawing which have excellent deep drawability and excellent adhesion of galvanized coating, having a chemical composition containing, all by mass, 0.01% or less C, 0.2% or less Si, 0.05–1.0% Mn, 0.10% or less P, 0.02% or less S, 0.005–0.08% sol.Al, and 0.006% or less N, and further containing Ti (mass %) and/or Nb (mass %) solely or in combination within a range in which a relationship between the effective amount of Ti (hereinafter referred to as Ti*) defined by the following formula (1) and the amounts of Nb and C satisfies the following formula (2), $$Ti^* = \text{total Ti} - \{(48/32) \times S + (48/14) \times N\} \quad (1)$$

$$1 \leqq (Ti^*/48 + Nb/93)/(C/12) \leqq 4.5 \quad (2)$$

and the balance of Fe and inevitable impurities, characterized in that 10 to 100 mass ppm solid-solute carbon is contained within the range 100 μm deep from the surface of the steel sheets through the thickness direction.

4. Cold-rolled sheets or hot-dip galvanized cold-rolled steel sheets as defined in any one of claims 1 to 3, wherein said steel sheets further contain 0.003% or less B.

* * * * *